US009458541B2

(12) United States Patent
Arnd et al.

(10) Patent No.: US 9,458,541 B2
(45) Date of Patent: Oct. 4, 2016

(54) METHOD FOR ELECTROLESS PLATING OF TIN AND TIN ALLOYS

(75) Inventors: Kilian Arnd, Berlin (DE); Jens Wegricht, Berlin (DE); Isabel-Roda Hirsekorn, Paulinenaue (DE); Hans Jurgen Schreier, Velten (DE)

(73) Assignee: Atotech Deutschland GmbH, Berlin (DE)

( * ) Notice: Subject to any disclaimer, the term of this patent is extended or adjusted under 35 U.S.C. 154(b) by 723 days.

(21) Appl. No.: 13/390,700

(22) PCT Filed: Aug. 24, 2010

(86) PCT No.: PCT/EP2010/005330

§ 371 (c)(1),
(2), (4) Date: Feb. 16, 2012

(87) PCT Pub. No.: WO2011/023411

PCT Pub. Date: Mar. 3, 2011

(65) Prior Publication Data

US 2012/0148733 A1 Jun. 14, 2012

(30) Foreign Application Priority Data

Aug. 24, 2009 (EP) ..... 09168492

(51) Int. Cl.
*C23C 18/54* (2006.01)
*C23C 18/31* (2006.01)
(Continued)

(52) U.S. Cl.
CPC ..... *C23C 18/54* (2013.01); *C23C 18/165* (2013.01); *C23C 18/1651* (2013.01); *C23C 18/31* (2013.01); *C23C 18/38* (2013.01)

(58) Field of Classification Search
CPC ..... C23C 18/54
USPC ..... 427/97.1
See application file for complete search history.

(56) References Cited

U.S. PATENT DOCUMENTS 3,917,486 A * 11/1975 Schneble, Jr. ..... 106/1.25
7,148,569 B1 * 12/2006 Wang ..... 257/738

(Continued)

FOREIGN PATENT DOCUMENTS

DE 19755185 6/1999
EP 0503389 9/1992

(Continued)

OTHER PUBLICATIONS

G. Rozovskij et al; "Copper Behavior During Immersion Deposition of Tin", Journal of Dairy Science, American Dairy Science Association, US, vol. 73, No. 4, Apr. 1, 1990, pp. 60-62, XP000170833.

(Continued)

*Primary Examiner* — Katherine A Bareford
(74) *Attorney, Agent, or Firm* — Renner, Otto, Boisselle & Sklar, LLP

(57) ABSTRACT

The invention relates to a method for electroless (immersion) plating of tin and tin alloys having a thickness of ≥1 μm as a final finish in the manufacture of printed circuit boards, IC substrates, semiconductor wafers and the like. The method utilizes an electroless plated sacrificial layer of copper between the copper contact pad and the electroless plated tin layer which is dissolved completely during tin plating. The method compensates the undesired loss of copper from a contact pad during electroless plating of thick tin layers.

9 Claims, 1 Drawing Sheet

Figure 1A:
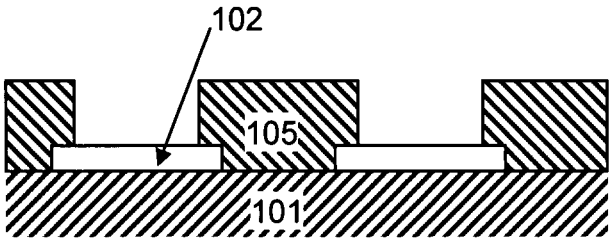

(51) Int. Cl.
*C23C 18/38* (2006.01)
*C23C 18/16* (2006.01)

(56) References Cited

U.S. PATENT DOCUMENTS

| | | | | |
|---|---|---|---|---|
| 2004/0224491 | A1* | 11/2004 | Datta | 438/613 |
| 2006/0237097 | A1* | 10/2006 | Lau et al. | 148/242 |
| 2008/0036079 | A1 | 2/2008 | Chen et al. | |
| 2008/0099799 | A1* | 5/2008 | Mathew et al. | 257/276 |
| 2009/0176366 | A1* | 7/2009 | Mathew et al. | 438/643 |

FOREIGN PATENT DOCUMENTS

| | | |
|---|---|---|
| JP | 9170083 | 6/1997 |
| JP | 2000309876 | 11/2000 |
| WO | 2005123987 | 12/2005 |

OTHER PUBLICATIONS

PCT/EP2010/005330; PCT International Search Report and Written Opinion of the International Searching Authority dated Dec. 13, 2010.

Official Action for Japanese Patent Application No. 2012-525940 dated Sep. 1, 2014.

* cited by examiner

METHOD FOR ELECTROLESS PLATING OF TIN AND TIN ALLOYS

FIELD OF THE INVENTION

The present invention relates to a method for electroless plating of tin and tin alloys as a final finish in the manufacturing of printed circuit boards, IC substrates, semiconductor wafers and the like.

BACKGROUND OF THE INVENTION

Tin surfaces are used in the manufacture of printed circuit boards, IC substrates, semiconductor wafers and related devices as a final finish, i.e., serving as a solderable or bondable surface for subsequent assembly steps. Tin is mostly deposited onto copper features of a substrate denoted as contact pads. The method of choice for this application is deposition of tin by electroless plating procedures with immersion plating as the most commonly applied method. The immersion plating process of tin or tin alloys—also called exchange reaction, cementation or displacement plating—onto a copper surface follows formula (1)

$$Sn^{2+}+2Cu \rightarrow Sn+2Cu^{+} \quad (1).$$

The consequence of reaction (1) is that copper from the contact pad made of copper is dissolved during deposition of tin (The Electrodeposition of Tin and its Alloys, M. Jordan, E. G. Leuze Publishers, 1$^{st}$ Ed. 1995, p. 89-90).

The loss of copper during immersion tin plating can cause inacceptable failures in the manufacture of state of the art printed circuit boards (PCB) such as HDI PCB's (High Density Interconnect), IC substrates and semiconductor wafers which can have very thin or narrow copper contact pads to be coated with tin. Typical thickness or width values of contact pads of PCB's, IC substrates and semiconductor wafers are 50 μm, 25 μm, 15 μm or even less. Especially for contact pad dimensions below 25 μm the loss of copper during immersion tin plating has to be minimized and controlled. Otherwise, circuit interruptions and loss of copper pad adhesion to the substrate can occur.

The tin layer deposited onto a contact pad made of copper serves as a solderable and bondable surface for reflow and soldering processes as well as wire bonding. Tin layers for said applications typically have a thickness of ≤1 μm. On the other hand, a tin layer having a thickness of ≥1 μm or even ≥5 μm may be desirable. One possible application for this would be to serve as a solder depot for a successive soldering process. In such a case the corresponding loss of copper during immersion tin plating of a thin contact pad is not acceptable any more.

The amount of copper which constitutes a contact pad is even more reduced during reflow and soldering processes due to the formation of copper-tin intermetallic compounds (IMCs).

Höynck describes a process for deposition of thick tin-lead alloy layers by electroless plating onto contact pads made of copper (M. Höynck, Galvanotechnik 83, 1992, pp. 2101-2110). The loss of copper during deposition of the thick solderable layer is compensated by increasing the thickness of the contact pads by electroplating of copper prior to plating of the tin-lead alloy.

It is not possible to selectively deposit a thicker layer of copper by electroplating only where it is needed, i.e., onto the contact pads, since not all of the pads can be electrically contacted at this stage of the circuit board manufacture. Deposition of a thicker copper layer by electroplating in an earlier stage of the PCB manufacture or wafer metallization is not feasible because of restrictions in respect to achievable aspect ratios of successive copper etching steps.

Document US 2008/0036079 A1 discloses in the prior art section in paragraphs [0005]-[0007] a method for built up of a solderable contact pad in the manufacture of PCBs. The method comprises the steps of electroless plating of an adhesive layer, e.g. a tin layer, onto a copper contact pad. It is a disadvantage of the process that due to diffusion of copper the copper contact pad is decreased and a cavity is formed on the contacting site between the tin and copper (see Comparative Example 1 of the present invention).

Document US 2008/0036079 A1 further discloses in paragraphs [0025]-[0030] a specific embodiment of the invention for built up of a solderable contact pad in the manufacture of PCBs. The method comprises the steps of electroless plating of a copper layer onto a copper contact pad followed by immersion plating of an adhesive layer, e.g., a tin layer. The layer of copper plated with an electroless process serves as a reservoir for IMC formation during reflow and soldering operations. However, it is not the aim of said process that the copper layer deposited by electroless plating is completely consumed during immersion plating of the adhesive layer. The electroless copper layer should reduce the copper loss of the contact pad caused by formation of copper-tin IMCs during reflow and soldering processes. This process leads to an interface consisting of electroplated copper and electroless plated copper which is prone to form cracks after a reflow or soldering process, thus reduces the solder joint reliability (see Comparative Example 2 of the present invention).

OBJECT OF THE INVENTION

It is the object of the present invention to provide a method for immersion plating of tin and tin alloy layers—especially of those having a thickness ≥1 μm—onto copper contact pads, a) while minimizing the dissolution of copper from the contact pad during tin and tin alloy deposition and b) not creating interfaces of electroplated copper and electroless plated copper which reduces the solder reliability.

SUMMARY OF THE INVENTION

This object is achieved by a method for electroless plating of tin or tin alloys comprising the steps of (i) providing a substrate with a surface having copper contact pads and a layer of solder mask with openings that expose the surface of said contact pads, (ii) depositing a sacrificial layer of copper onto the contact pads by electroless plating and (iii) depositing tin or a tin alloy by immersion plating onto the sacrificial copper layer deposited in step (ii), characterised in that said sacrificial copper layer is completely dissolved during immersion plating of tin or a tin alloy.

DRAWINGS

Figure 1B:
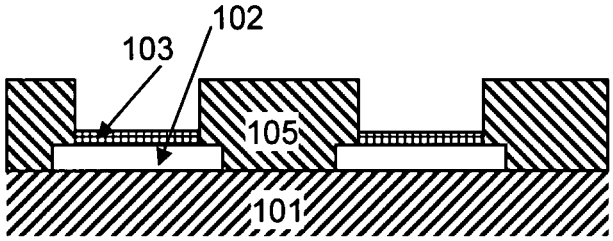
Figure 1C:
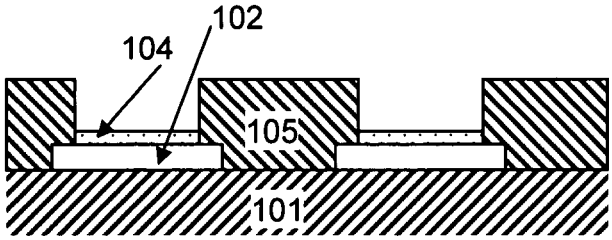

FIGS. 1*a*, 1*b* and 1*c* show the process of the present invention wherein a copper layer deposited by electroless plating is dissolved completely during immersion plating of tin or a tin alloy.

REFERENCE NUMERALS

| | |
|---|---|
| 101 | substrate |
| 102 | contact pads |
| 103 | sacrificial layer of copper |
| 104 | tin or tin alloy layer |
| 105 | solder mask layer |

DETAILED DESCRIPTION OF THE INVENTION

The method for electroless plating of tin and tin alloys according to the present invention comprises the steps (i) providing a substrate 101 having contact pads 102 and a solder mask layer 105 which exposes the surfaces of said contact pads, (i) providing a substrate 101 having contact pads 102 and a solder mask layer 105 which exposes the surfaces of said contact pads, (ii) depositing a sacrificial layer of copper 103 by electroless plating onto the contact pads 102 and (iii) depositing a tin or a tin alloy layer 104 by immersion plating onto the sacrificial layer of copper 103 deposited in step (ii), wherein the sacrificial layer of copper 103 deposited in step (ii) is completely dissolved during deposition of the tin or tin alloy layer 104 in step (iii).

Now referring to FIG. 1*a*, in accordance with a preferred embodiment of the present invention, there is provided a non-conductive substrate 101, which has contact pads 102 as a contact area embodiment on its surface. The non-conductive substrate 101 can be a circuit board which may be made of an organic material or a fiber-reinforced organic material or a particle-reinforced organic material, etc., for example, epoxy resin, polyimide, bismeleimide triazine, cyanate ester, polybenzocyclobutene, or glass fiber composite thereof, etc. The non-conductive substrate 101 can also be a semiconductor substrate.

Said contact pad 102 is typically formed from a metal material, such as copper, which is preferred and used throughout the Examples of the present invention.

According to the present invention, said contact pad 102 is not limited to a flat structure. Said contact pad 102 can be part of a via or trench which is coated with a tin or tin alloy layer 104. Vias and trenches preferably have a depth of 5-250 μm and a width of 5-200 μm.

The surface of the contact pads 102 is cleaned prior to electroless deposition of copper. In one embodiment of the present invention an acidic cleaner comprising an acid and a wetting agent is used for this purpose. Alternatively, or, in addition, if the surface of the contact pad is copper, it can be subjected to a micro etching process which provides a defined micro roughness of layer 102 and a clean copper surface. Micro etching is achieved by contacting the substrate 101 with a composition comprising an acid and an oxidant, for example a composition comprising sulphuric acid and hydrogen peroxide.

In the next step, it is preferable to activate the copper pad surface to assure initiation of the subsequent electroless copper process. A good initiator is palladium, and only a minute amount in the form of palladium seeds is needed which can be deposited in an immersion reaction. Care has to be taken that the palladium immersion bath used for this purpose only deposits palladium on the copper pads and not in the surrounding area, as this may lead to the formation of connections between the copper pads and, in turn, in electrical short circuiting.

The contact pads 102 are selectively coated with the sacrificial layer of copper 103 in step (ii) because the solder mask layer 105 only leaves the surface of contact pads 102 exposed (FIG. 1*b*). The sacrificial layer of copper 103 is deposited from electroless copper electrolytes and with procedures known in the art.

Electroless copper plating electrolytes comprise a source of copper ions, pH modifiers, complexing agents such as EDTA, alkanol amines or tartrate salts, accelerators, stabilizer additives and a reducing agent. In most cases formaldehyde is used as reducing agent, other common reducing agents are hypophosphite, dimethylamine borane and borohydrides. Typical stabilizer additives for electroless copper plating electrolytes are compounds such as mercaptobenzothiazole, thiourea, various other sulphur compounds, cyanide and/or ferrocyanide and/or cobaltocyanide salts, polyethyleneglycol derivatives, heterocyclic nitrogen compounds, methyl butynol, and propionitrile. The deposition speed can be adjusted by parameters such as plating bath temperature and plating time.

The thickness of the sacrificial copper layer 103 is adjusted in respect to the desired thickness of the later immersion plated layer of tin or a tin alloy 104, i.e., in a way that the complete sacrificial layer of copper 103 is dissolved during immersion plating of the tin or tin alloy layer 104 (FIG. 1*c*). Inventors have found that approximately 0.8 μm of the sacrificial layer of copper 103 are dissolved if 1 μm of the tin or tin alloy layer is deposited. If for example 5 μm of tin is to be deposited, 4 μm of copper needs to be deposited to assure a complete consumption of the sacrificial layer of copper 103. Approximately 0.8 μm is defined here as a range of 0.7 to 0.9 μm.

A deposition factor of approximately 0.8 is obtained for the deposition of the tin or tin alloy layer 104. The deposition factor as defined herein is the ratio of the thickness of the sacrificial layer of copper 103 which is dissolved during tin or tin alloy deposition and the thickness of the tin or tin alloy layer 104 until the entire sacrificial layer of copper 103 has been consumed. Approximately 0.8 is defined here as a deposition factor in the range of 0.7 to 0.9.

The thickness ratio of the tin or tin alloy layer 104 and the sacrificial layer of copper 103 is no more than 0.8 and preferably ranges from 0.3 to 0.8, more preferably from 0.4 to 0.75 and most preferably from 0.5 to 0.7. The thickness ratio as defined herein is the ratio the thickness of the sacrificial layer of copper 103 directly after deposition in step (ii) and of the thickness of the tin or tin alloy layer 104 deposited in step (iii). Therefore, a thickness ratio of 0.8 corresponds to a complete consumption of the sacrificial layer of copper 103. A thickness ratio of less than 0.8 leads to a consumption of the whole sacrificial layer of copper 103 and in addition to a partial consumption of the contact pad 102. This is preferred because the adhesion between the copper from a contact pad 102 and a tin or tin alloy layer 104 is improved. However, a thickness ratio of smaller than 0.3 leads to a undesired high consumption of a contact pad 102 and is therefore not desired.

When taking into account the deposition factor of approximately 0.8 and the thickness ratio of the tin or tin alloy layer 104 and the sacrificial layer of copper 103 which ranges from 0.3 to 0.8 a thickness ratio of 0.8 will lead to a complete dissolution of the sacrificial layer of copper 103 during deposition of the tin or tin alloy layer 104. The relationship between deposition factor of approximately 0.8 and thickness ratios of the sacrificial layer of copper 103 and the tin or tin alloy layer 104 according to the present invention is further explained in table 1. On the other hand, a thickness factor of 0.3 and a deposition factor of 0.8 leads to a partial dissolution of the contact pad 102.

TABLE 1

Thicknesses of sacrificial copper layer 103 and tin or tin alloy layer 104 derived by a deposition factor of 0.8 and thickness ratio values of 0.3, 0.5 and 0.8:

| Thickness ratio | Thickness tin or tin alloy layer 104 [μm] | Thickness of sacrificial copper layer 103 [μm] | Thickness loss of the contact pad 102 [μm] |
|---|---|---|---|
| 0.8 | 3 | 2.4 | 0 |
| 0.5 | 3 | 1.5 | 0.9 |
| 0.3 | 3 | 0.9 | 1.5 |
| 0.8 | 5 | 4 | 0 |
| 0.5 | 5 | 2.5 | 1.5 |
| 0.3 | 5 | 1.5 | 2.5 |

In the preferred embodiment of the present invention the sacrificial copper layer 103 is completely dissolved by the immersion plated tin or tin alloy layer 104.

In another embodiment of the present invention also a portion of the copper of the copper contact pad 102 equal to ≤50% of the plated tin layer 104 thickness is dissolved during the immersion plating. While a thickness of 50% of the plated tin layer 104 thickness is the maximum amount of copper thickness to be dissolved of the contact pad 102 more preferred is ≤40%, even more ≤25%, most preferred ≤10%. Such dissolution of copper from the contact pad can be advantageous because it results in an increased adhesion of the subsequently formed tin or tin alloy layer to the copper layer of the contact pad 102.

In one embodiment of the present invention the sacrificial copper layer 103 is treated with an acidic cleaner and optionally with a composition for micro etching of the surface as described for the copper contact pad surface.

In another embodiment of the present invention the surface of the sacrificial layer of copper 103 is only rinsed with water after electroless deposition of copper.

Next, the substrate is contacted with an immersion plating electrolyte for deposition of tin or a tin alloy.

Electroless tin and tin alloy plating electrolytes for immersion plating are known in the art. Preferred electrolytes comprise a source of $Sn^{2+}$ ions such as tin(II) methanesulfonate, an acid such as sulphuric acid or methanesulfonic acid, a complexing agent for copper ions, e.g., thiourea or a thiourea derivative, imidazoles, benzimidazoles, benzotriazoles, urea, citric acid and mixtures thereof. Optionally, the plating bath further comprises at least one further source for at least one further metal ion which is not tin. Typical further metals to be co-deposited with tin to form a tin alloy are silver, gold, gallium, indium, germanium, antimony, bismuth, copper and mixtures thereof. Preferred tin alloys are tin-silver, tin-silver-copper and tin-copper alloys. The plating speed can be controlled for example by adjusting the plating bath temperature and the plating time. The plating bath is operated in a temperature range of 50° C. to 98° C., more preferably 70° C. to 95° C. The plating time ranges from 5 min to 120 min, more preferably from 15 min to 60 min. A typical tin deposition process is done at a temperature of 95° C. for 30 min, while nitrogen or another inert gas is bubbled through the tin bath.

The workpieces can be treated in current dip (immersion) lines. For treating printed circuit boards, it has been found particularly advantageous to utilize what are termed conveyorized lines in which the printed circuit boards are conveyorized through the line on a horizontal conveying path while being contacted with the treatment solutions through appropriate nozzles such as spray or flow nozzles. For this purpose, the printed circuit boards can preferably be positioned horizontally or vertically.

After the tin or tin alloy deposition, it is advantageous to rinse the boards in a solution containing thiourea or another strong complexant for copper ions to remove any copper ions from the tin or tin alloy surface.

The life time of the tin or tin alloy plating process can be further enhanced by a continuous removal of copper ions complexed by thiourea with a selective crystallization process as disclosed in U.S. Pat. No. 5,211,831 which is incorporated herein by reference.

Stannic ions which are enriched in the immersion plating bath during operation can be continuously reduced to stannous ions as disclosed in EP 1 427 869 B1 which is incorporated herein by reference.

In still another embodiment of the present invention the tin or tin alloy surface is contacted with a post-treatment composition comprising one or more inorganic or organic phosphoric acids or salts thereof which inhibits oxide formation on said surface. Such compositions are disclosed in EP 1 716 949 B1 which is incorporated herein by reference. Said post-treatment suppresses "yellowing", i.e., oxidation of the tin or tin alloy surface during storage of the plated substrate.

The advantages of the present invention in respect to the processes known from prior art are:

The inventive process allows the immersion plating of tin or tin alloys onto copper contact pads having a thickness of ≤50 μm, more preferred ≤25 μm, even more preferred ≤15 μm without damaging the copper contact pads due to dissolution of copper from said contact pads according to formula (1). The present invention further allows the deposition of thick tin and tin alloy layers by immersion plating. A thick tin and tin alloy layer has a thickness of ≥1 μm and up to 20 μm, more preferably from 1.5 μm up to 10 μm. Such thick tin and tin alloy coatings can be used as a solder depot. Thin tin layers, having a thickness of ≤1 μm, are only suitable as a solderable and bondable surface, but do not provide a solder depot in addition.

According to the present invention, a substrate having an immersion plated layer of tin or a tin alloy with a thickness of ≥1 μm on a contact pad made of copper has a loss of copper from the contact pad which is less than 50% of the thickness of the immersion plated tin or tin alloy layer, i.e., if the immersion plated layer of tin has a thickness of 3 μm, the loss of copper from the contact pad is ≤1.5 μm due to the sacrificial layer of electroless plated copper on the contact pad made of copper.

The surface roughness of a tin or tin alloy layer 104 deposited onto the sacrificial layer of copper 103 is reproducibly lower than that of a tin or tin alloy layer deposited directly onto an electroplated copper layer constituting a contact pad. This is surprising as the skilled person would expect the opposite (J. G. Allen, C. Granzulea, T. B. Ring, "Solderability Evaluation of Immersion Tin-Coated 3-Dimensional Molded Circuit Boards", Proceedings of the 3rd International SAMPE Electronics Conference, Jun. 20-22, 1989, pp. 1099-1110). A tin or tin alloy surface having a low surface roughness is preferred for successive soldering or bonding procedures.

The tendency of whisker formation during storage of substrates manufactured according to the present invention is reduced in comparison with immersion tin or tin alloy plated substrates manufactured by methods known from prior art.

Further, due to the smoother tin or tin alloy surface which is generated by the process according to the present invention, corrosion of said tin or tin alloy surface is also reduced compared to rougher surface morphologies obtained by immersion plating processes known in the art.

EXAMPLES

The invention will now be illustrated by reference to the following non-limiting examples.

Substrates having copper contact pads of various sizes were used throughout all examples. The contact pad sizes ranged from very small (150 μm long stripes having a width down to 30 μm) to large (round contact pads having a diameter of approx. 600 μm). Alternatively, deposition was done on substrates having an unstructured copper surface.

An immersion plating bath comprising tin(II) methanesulfonate, methanesulfonic acid and thiourea was used throughout all examples.

The contact pad surfaces made of copper were first cleaned with an acidic cleaner (Pro Select H, a product of Atotech Deutschland GmbH) and etched with MicroEtch H (a product of Atotech Deutschland GmbH).

In case of Comparative Example 1 a tin layer 104 (FIG. 1*c*) was deposited from the immersion plating bath directly onto the copper contact pads 102 (FIG. 1*a*) whereas in Comparative Example 2 and Example 1 a tin layer was immersion plated after an additional copper layer 103 (FIG. 1*b*) was deposited from an electroless plating bath onto the contact pads (Printoganth® P Plus, a product of Atotech Deutschland GmbH). The contact pads were activated with a composition comprising palladium ions prior to electroless deposition of copper (Activator 1000, a product from Atotech Deutschland GmbH).

Test Methods:

Determination of Layer Thickness

The thicknesses of tin and copper layers deposited by electroless plating were monitored using a commercial X-ray fluorescence (XRF) tool. In addition, circuit board samples were cross sectioned and the thickness of the above mentioned layers were investigated with an optical light microscope.

Solder Joint Reliability

The reliability of solder joints was examined by placing a solder ball (Indium SAC305 balls having a diameter of 450 μm) onto contact pads having a tin surface and a diameter of 400 μm and a printed flux (Alpha WS9160-M7). The specimens were reflowed under nitrogen atmosphere in a typical lead-free solder profile. The solder joint reliability was then determined by shearing off the solder bumps before and after ageing. The resulting average shear forces are given in gram.

Definition of failure modes obtained from a solder joint reliability test as described above:

Failure mode 1→less than 5% fracture in the solder joint interface and most desirable.

Failure mode 2→5 to 25% fracture in the solder joint interface and less desirable.

Comparative Example 1

The contact pads of a substrate were immersion tin plated after cleaning and etching.

The thickness of the tin layer was 4.94 μm. The loss of copper from the contact pad was 3.8 μm, i.e., 77% in respect to the thickness of the plated tin layer.

Comparative Example 2

After cleaning and etching the surface of the contact pads a layer of copper was deposited from an electroless plating bath followed by activation of the electroless plated copper surface and immersion plating of tin.

The thickness of the copper layer deposited from an electroless plating bath was 2.71 μm and that of the tin layer 3.46 μm. Approx. 0.65 μm of the electroless plated copper layer remained after tin deposition.

The average shear forces were 690 g and the failure modes found were 5% failure mode 1 and 95% failure mode 2.

Example 1

After cleaning and etching the surface of the contact pads a layer of copper was deposited from an electroless plating bath followed by activation of the electroless plated copper surface and immersion plating of tin.

The thickness of the copper layer deposited from an electroless plating bath was 1.21 μm and that of the tin layer 3.9 μm. The loss of copper from the contact pad was 1.36 μm, i.e., 35% in respect to the thickness of the plated tin layer.

The average shear forces were 755 g and the failure modes found were 55% failure mode 1 and 45% failure mode 2.

The invention claimed is:

1. A method for electroless plating of tin and tin alloys comprising the steps of (i) providing a substrate having copper contact pads and a solder mask layer which exposes said copper contact pads, (ii) depositing a sacrificial layer of copper by electroless plating directly onto the copper contact pads and (iii) depositing a tin or a tin alloy by electroless plating onto the sacrificial layer of copper deposited in step (ii)

wherein the thickness ratio ranges from 0.3 to 0.8 and wherein the thickness ratio as defined herein is the ratio of the thickness of the sacrificial layer of copper directly after deposition in step (ii) and of the thickness of the tin or tin alloy layer deposited in step (iii).

2. A method according to claim 1 wherein the thickness ratio ranges from 0.4 to 0.75.

3. A method according to claim 1 wherein the thickness ratio ranges from 0.5 to 0.7.

4. A method according to claim 1 wherein the tin or tin alloy layer is deposited by immersion plating.

5. A method according to claim 1 wherein the thickness of the tin or tin alloy layer ranges from 1 μm to 10 μm.

6. A method according to claim 1 wherein the sacrificial layer of copper is dissolved completely and furthermore a portion of the copper contact pad equal to ≤50% of the plated tin layer thickness in step (iii) is dissolved.

7. A method according to claim 1 wherein the tin alloy deposited in (iii) is selected from the group consisting of Sn—Ag, Sn—Ag—Cu, Sn—Cu, and Sn—Ni alloys.

8. A method according to claim 1 wherein step (iii) is conducted in a tin plating composition comprising a source of $Sn^{2+}$ ions, an acid, an organic sulphur compound, and optionally, a source of at least one further metal.

9. A method according to claim 1 wherein the tin or tin alloy layer is treated after step (iii) with a composition comprising a phosphorous compound which is selected from the group consisting of inorganic phosphoric acids, organic phosphoric acids, salts of inorganic phosphoric acids and salts of organic phosphoric acids.

* * * * *